US006739588B2

(12) United States Patent
Köster et al.

(10) Patent No.: US 6,739,588 B2
(45) Date of Patent: May 25, 2004

(54) METHOD AND DEVICE FOR SEPARATING PRINTING PLATES

(75) Inventors: Oliver Köster, Schwedeneck (DE); Thorsten Mühlena, Neumünster (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 95 days.

(21) Appl. No.: 10/059,542

(22) Filed: Jan. 29, 2002

(65) Prior Publication Data

US 2002/0101027 A1 Aug. 1, 2002

(30) Foreign Application Priority Data

Jan. 29, 2001 (DE) ..... 101 04 078

(51) Int. Cl.[7] ..... B65H 3/46; B65H 5/14; B65H 3/48

(52) U.S. Cl. ..... 271/106; 271/20

(58) Field of Search ..... 271/106, 20

(56) References Cited

U.S. PATENT DOCUMENTS

| | | | | | |
|---|---|---|---|---|---|
| 1,112,609 | A | * | 10/1914 | Harris | 271/22 |
| 1,289,051 | A | * | 12/1918 | Lane et al. | 271/20 |
| 2,108,702 | A | * | 2/1938 | Backhouse | 271/20 |
| 2,231,339 | A | * | 2/1941 | Krueger | 271/95 |
| 3,275,317 | A | * | 9/1966 | Fromm, Jr. | 271/106 |
| 3,684,276 | A | * | 8/1972 | Bridgeman | 271/20 |
| 3,997,153 | A | * | 12/1976 | Britt et al. | 271/93 |
| 5,137,268 | A | * | 8/1992 | Suya et al. | 271/20 |
| 5,156,387 | A | * | 10/1992 | Seto | 271/20 |
| 6,345,818 | B1 | * | 2/2002 | Stephan et al. | 271/91 |
| 6,398,208 | B1 | * | 6/2002 | Yang et al. | 271/107 |
| 6,431,623 | B1 | | 8/2002 | Roeters et al. | |
| 6,571,709 | B1 | * | 6/2003 | Marincic et al. | 101/477 |

FOREIGN PATENT DOCUMENTS

| | | | | |
|---|---|---|---|---|
| DE | 4002324 | * | 1/1990 | 271/106 |
| DE | 42 10 024 A1 | | 9/1993 | |
| EP | 0 436 892 A2 | | 7/1991 | |
| JP | 3-223035 | * | 10/1971 | 271/106 |
| JP | 55-61542 | * | 5/1980 | 271/20 |
| JP | 61-136838 | * | 6/1986 | 271/106 |
| JP | 63-139834 | * | 6/1988 | 271/106 |
| JP | 3-3834 | * | 1/1991 | 271/106 |
| WO | 00/76899 A1 | | 12/2000 | |

* cited by examiner

*Primary Examiner*—Donald P Walsh
*Assistant Examiner*—Daniel K Schlak
(74) *Attorney, Agent, or Firm*—Laurence A. Greenberg; Werner H. Stemer; Ralph E. Locher

(57) ABSTRACT

A method and a device for separating flat, sheet-like elements from a stack of such elements, in particular, from a stack of unexposed printing plates that will be automatically loaded into a printing plate recorder. When the upper or front element in the stack is being separated from the stack, an edge area of this element is curved up in some way.

2 Claims, 2 Drawing Sheets

METHOD AND DEVICE FOR SEPARATING PRINTING PLATES

BACKGROUND OF THE INVENTION

Field of the Invention

The invention relates to a method for separating flat, sheet-like elements from a stack of such elements, in particular, from a stack of unexposed printing plates that will be automatically loaded into a printing plate recorder.

In addition, the invention relates to a device for separating flat, sheet-like elements, from a stack of such elements, in particular, from a stack of unexposed printing plates that will be automatically loaded into a printing plate recorder. The device has an acquisition element for acquiring at least the edge of the respective upper or front element in the stack, and this acquisition element is preferably for implementing the aforementioned method.

Flat, sheet-like elements are kept ready or stored in a stack, in particular, to be automatically loaded into a printing plate recorder that records images on the printing plates so that they can be subsequently used in an offset printing machine, however, printing plates are also stored in a stack for other purposes. The elements in the stack are either lying flat on one another or are leaning upright against one another. Irrespective of the surface condition, flat adhesion most often occurs between successive elements, and it is possible for the respective surface condition to further promote adhesion or even sticking. For a loading operation, however, such elements usually have to be separated one after another, in other words each element is individually separated from the stack. This must be carried out reliably to prevent disruption of the following operational step. For an automatic loading operation, the automatic mechanism should reliably ensure that the elements are separated and loaded without requiring monitoring or intervention by an operator. Such an intervention would interrupt the automatic mechanism and would limit the value of the automatic loading operation.

The requisite reliability is not satisfactorily implemented in the case of autoloaders for printing plate recorders, and this in particular, is a problem.

SUMMARY OF THE INVENTION

It is accordingly an object of the invention to provide a device and a method for separating flat, sheet-like elements from a stack of such elements, which overcomes the above-mentioned disadvantages of the prior art apparatus and methods of this general type.

In particular, it is an object to improve the reliability of the separation operation, preferably cost-effectively, and by using relatively simple means or actions.

With the foregoing and other objects in view there is provided, in accordance with the invention, a method for separating a flat, sheet-like element from a stack of flat, sheet-like elements, that includes a step of: causing an edge of a flat, sheet-like element to curve outwardly while separating the element from a stack of flat, sheet-like elements. The element is either an upper flat, sheet-like element of the stack or a front flat, sheet-like element of the stack.

In accordance with an added feature of the invention, the flat, sheet-like elements are printing plates to be exposed.

In accordance with an additional feature of the invention, the flat, sheet-like elements are printing plates ready to be automatically loaded into a printing plate recorder.

In accordance with another feature of the invention, while separating the element from the stack, air is blown in between the element and the stack, and the air is blown in from the edge of the element that is being curved outwardly.

In accordance with a further feature of the invention, the flat, sheet-like elements have butt edges; and the air is blown into the stack on a line transverse to all of the butt edges of the stack.

In accordance with a further added feature of the invention, the stack is formed by leaning the flat, sheet-like elements against one another at an angle with respect to a vertical line; and the element is separated from the stack by gripping a lower horizontal edge region of the front flat, sheet-like element of the stack.

With the foregoing and other objects in view there is provided, in accordance with the invention, a device for separating flat, sheet-like elements. The device includes an acquisition element for acquiring at least an edge of a flat, sheet-like element from a stack of flat, sheet-like elements. The acquisition element is configured for producing a curvature in at least one section of the edge of the flat, sheet-like element to be gripped.

In accordance with an added feature of the invention, the acquisition element includes suction elements for attracting the flat, sheet-like element to be gripped using suction; and at least one of the suction elements is spaced further apart from a surface of the flat, sheet-like element to be gripped than others of the suction elements.

In accordance with an additional feature of the invention, at least one air blowing element is provided for blowing air under the flat, sheet-like element to be gripped. The air blowing element is assigned to the section of the edge of the flat, sheet-like element upon which the curvature is produced.

In accordance with another feature of the invention, at least one air blowing element is provided for blowing air under the flat, sheet-like element to be gripped. The air blowing element is assigned to the section of the edge of the flat, sheet-like element upon which the curvature is produced.

In accordance with a further added feature of the invention, the air blowing element is formed with an exit slot that extends over an entire height of the stack, transversely with respect to butt edges of the flat, sheet-like elements.

The object of the invention is thus obtained by ensuring that when the upper or front element in the stack is being separated from the stack, an edge area of this element is curved up in some way.

The important factor is that the flat adhesion between the element to be removed and the next element is broken through locally over a portion of an edge region and this disruption is easily propagated as the element is further removed from the next element in the stack. If an attempt were made to grip the flat element uniformly or centrally, an air vacuum would be formed, which would promote and reinforce the adhesion and in this way would oppose further separation of the element. If, however, as provided by the invention, the edge of the element to be removed is curved outwardly, then local distortion or creasing occurs, which in a beneficial way disrupts the tendency to adhere.

The separation of the gripped element can be assisted and reinforced by blowing in air from the butt edge of the curved edge, between the element to be separated and the stack.

The entire stack is preferably ventilated transversely with respect to the butt edges of the elements. The elements are preferably set leaning against one another to form a stack. The elements, in each case, are gripped at their lower edge to separate them from the stack, and preferably are also ventilated from below, by placing the stack on one or more ventilation slots.

In principle, an extremely wide range of acquisition elements is conceivable, which could be arranged or constructed to achieve local disruption of the flat adhesion. For example, hook-like claws, clamps, frictional fingers, tongues, or analogous devices can be used.

Suction elements in various arrangements or numbers can be provided to grip and lift the sheet-like elements. In particular when such suction elements are used, at least one of the suction elements can be spaced further apart from the surface of the element to be attracted by suction than others of the suction elements. The suction path provided by this more distant suction element is greater than that of the other suction elements so that a bulge or curvature in the sheet-like element automatically results at this point. The sheet-like element strikes other, more or less adjacent, suction elements sooner and is therefore forced to bend. In this case, a few millimeters difference in travel is mostly sufficient. This difference in travel can be achieved in a particularly and surprisingly simple and cost-effective way, for example, by using one less washer fewer when mounting the spaced-apart suction element. The washer is left out as a spacer.

At least one air blowing element is preferably positioned in association with the area of the gripped flat element that will be curved. For example, the air blowing element can be positioned in association with the spaced-apart suction element. It is also possible for further air blowing elements to be arranged there or in the further surroundings.

In accordance with another feature of the invention, at least one air blowing element can extend over the entire depth of the stack and ventilate the latter, and can assist the ability of the elements in the entire stack to be separated.

Other features which are considered as characteristic for the invention are set forth in the appended claims.

Although the invention is illustrated and described herein as embodied in a method and device for separating printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
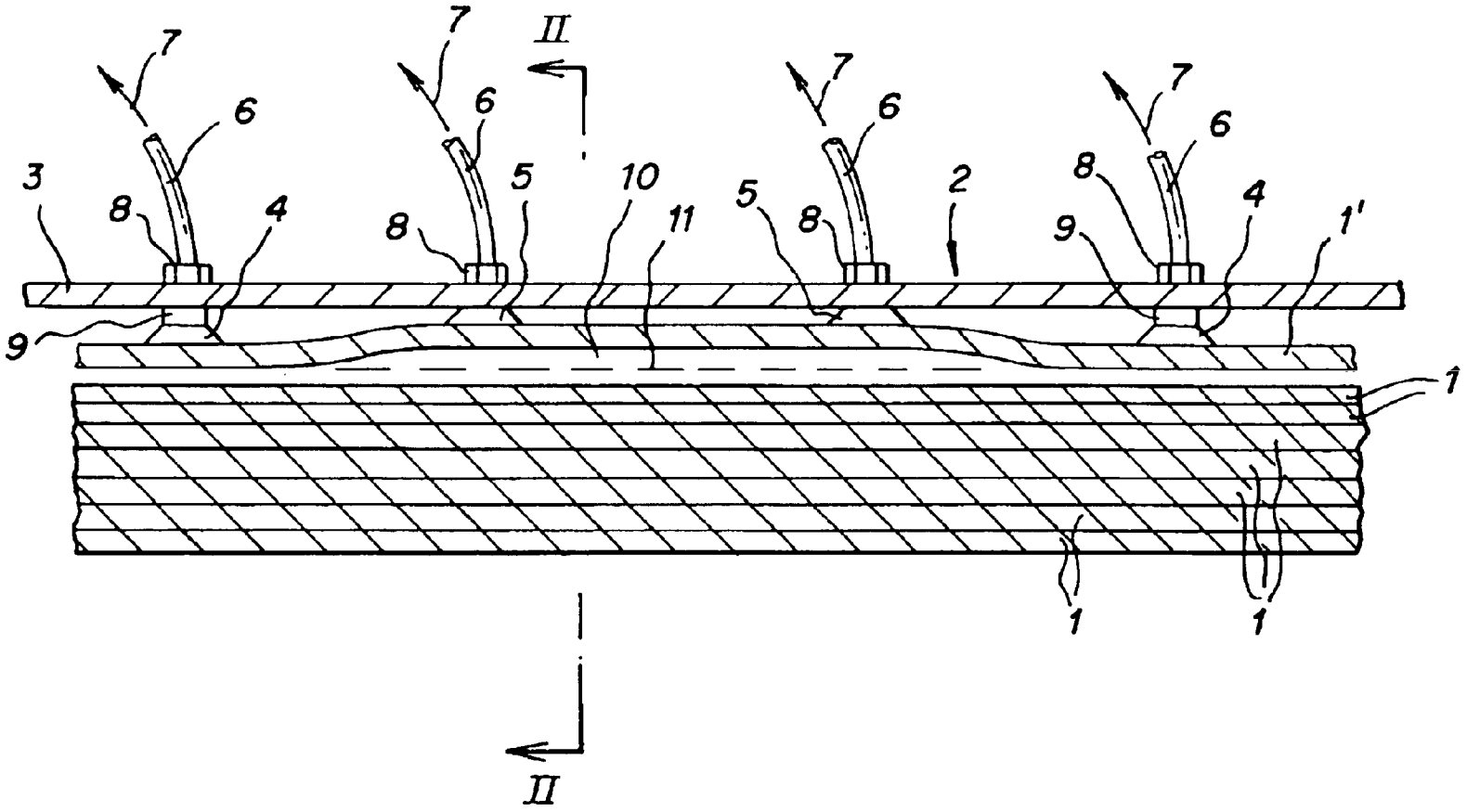
FIG. 1 shows a stack of printing plates with an acquisition element.
Figure 2:
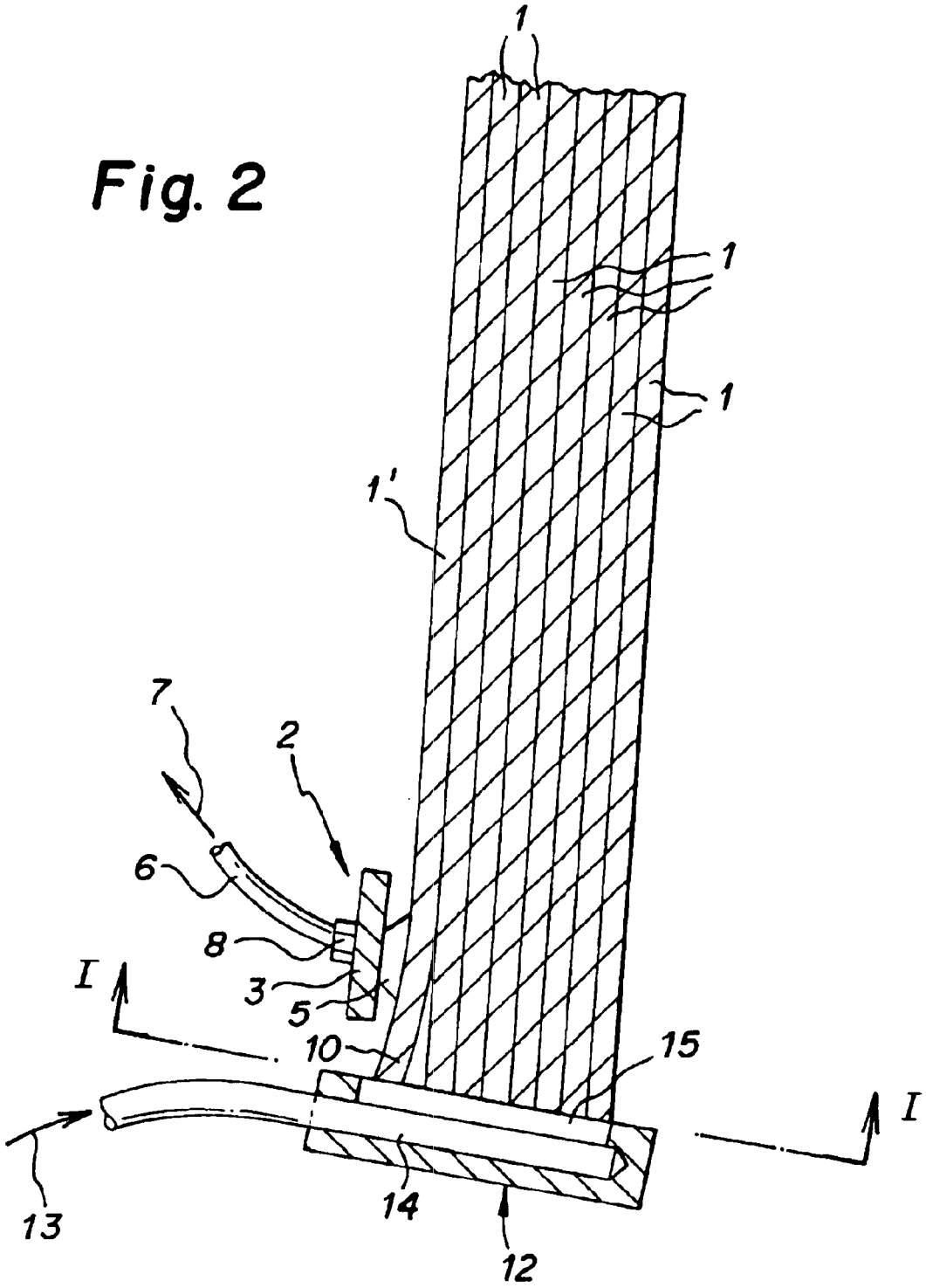
FIG. 2 shows a view taken along the dash-dotted line designated by II—II in FIG. 1.

Referring now to the figures of the drawing in detail and first, particularly, to FIG. 1 thereof, there is shown a stack of printing plates 1, 1' that will subsequently be exposed. The views shown in the figures are in schematic form and are not to scale. The view shown in FIG. 1 is taken through the dash-dotted line designated by I—I in FIG. 2. The view shown in FIG. 2 is through a section along the dash-dotted line designated by II—II in FIG. 1. The printing plates 1, 1' can either be stacked vertically, in which case the printing plate designated by 1' is the upper plate of the stack, or the printing plates 1, 1' can be stacked horizontally, in which case, the printing plate designated by 1' is the front plate of the stack. The printing plate designated by 1' is illustrated at the start of the separation operation as it is being removed and detached from the stack.

In order to separate and grip the printing plate, an acquisition element 2 is provided, which may be a constituent part of a loading device of a printing plate recorder that is not illustrated. The acquisition element 2 substantially includes a bar 3 that is arranged such that it can be moved pivotably about a pivot axis running along the extent of the bar 3. Using a pivoting movement, the process of removing the front printing plate 1', which has just begun in the lower region of the printing plate 1' as shown in FIG. 2, can be continued in the same direction until the printing plate 1' can be introduced, for example, approximately horizontally in front of the stack, into a recorder. Suction elements 4, 5 are arranged on the bar 3. Only a broken section of the printing plates 1, 1' and of the bar 3 are illustrated in FIG. 1, and correspondingly only a few suction elements 4, 5 are illustrated. In order to attract the printing plate 1' using suction, air is sucked in from the suction elements 4, 5, and is led away in the direction of the arrows 7 by hoses 6 or similar means to a pumping device (not illustrated). The suction elements 4 are arranged on the bar 3 using threaded connections 8 and washers 9. Washers 9 are not used with the suction elements 5, so that the suction elements 5 are arranged closer to the bar 3 and are spaced further away from the stack of printing plates 1, 1'.

As shown in FIG. 1, a curvature 10 is produced at the part of the printing plate 1' that is gripped by the suction elements 5. The part of the printing plate 1' with the curvature 10 is removed from the line of alignment 11 (shown dashed) of the other regions of the printing plate 1'. It is therefore possible for air to enter the curvature 10, which helps to separate the printing plate 1' from the stack.

FIG. 2 shows an air blowing element 12 located underneath the stack of printing plates 1, 1'. The air blowing element 12 actively sucks air in the direction shown by the arrow 13 and blows the air over the entire depth of the stack into the curvature 10 and into the interspaces of the other printing plates 1. The air blowing element 12, for example, can be formed in the shape of a block and can be provided with a hole 14. The hole 14 opens over the entire depth of the stack via a slot 15.

We claim:

1. In combination with a stack of flat, sheet-like elements being unexposed printing plates configured to be automatically loaded into a printing plate recorder, a device for separating the flat, sheet-like elements, comprising:

an acquisition element for acquiring at least an edge of a flat, sheet-like element from a stack of flat, sheet-like elements;

said acquisition element configured for producing a curvature in at least one section of the edge of the flat, sheet-like element to be gripped;

said acquisition element having suction elements using suction for attracting and gripping the flat, sheet-like element;

at least one of said suction elements spaced further apart from a surface of the flat sheet-like element to be gripped than others of said suction elements;

at least one air blowing element for blowing air under the flat, sheet-like element to be gripped;

said air blowing element being assigned to the section of the edge of the flat, sheet-like element upon which the curvature is produced; and said air blowing element constructed with an exit slot extending over an entire height of the stack, transversely with respect to butt edges of the flat, sheet-like elements.

2. In combination with a stack of flat, sheet-like elements being unexposed printing plates, a device for separating the flat, sheet-like elements, comprising:

an acquisition element for acquiring at least an edge of a flat, sheet-like element from a stack of flat, sheet-like elements;

said acquisition element configured for producing a curvature in at least one section of the edge of the flat, sheet-like element to be gripped;

said acquisition element having suction elements using suction for attracting and gripping the flat, sheet-like element;

at least one of said suction elements spaced further apart from a surface of the flat sheet-like element to be gripped than others of said suction elements;

at least one air blowing element for blowing air under the flat, sheet-like element to be gripped;

said air blowing element being assigned to the section of the edge of the flat, sheet-like element upon which the curvature is produced; and said air blowing element constructed with an exit slot extending over an entire height of the stack, transversely with respect to butt edges of the flat, sheet-like elements.

* * * * *